US009974355B2

(12) United States Patent
Goodman

(10) Patent No.: US 9,974,355 B2
(45) Date of Patent: May 22, 2018

(54) PADDED FOOT SUPPORT WITH A BALL OF FOOT DEPRESSION

(71) Applicant: Tina Lorraine Goodman, Austin, TX (US)

(72) Inventor: Tina Lorraine Goodman, Austin, TX (US)

(73) Assignee: HEELHO LLC, Austin, TX (US)

( * ) Notice: Subject to any disclaimer, the term of this patent is extended or adjusted under 35 U.S.C. 154(b) by 0 days. days.

(21) Appl. No.: 14/973,679

(22) Filed: Dec. 17, 2015

(65) Prior Publication Data

US 2016/0174653 A1 Jun. 23, 2016

Related U.S. Application Data

(60) Provisional application No. 62/093,115, filed on Dec. 17, 2014.

(51) Int. Cl.
*A43B 7/14* (2006.01)
*A43B 7/30* (2006.01)

(52) U.S. Cl.
CPC ..... *A43B 7/1425* (2013.01); *A43B 7/1405* (2013.01); *A43B 7/149* (2013.01); *A43B 7/1445* (2013.01); *A43B 7/1485* (2013.01); *A43B 7/30* (2013.01)

(58) Field of Classification Search
CPC ... A43B 7/1405; A43B 7/1425; A43B 7/1445; A43B 7/1485; A43B 7/30; A43B 7/14
USPC ..... 36/71, 43, 44, 174, 180, 182
See application file for complete search history.

(56) References Cited

U.S. PATENT DOCUMENTS 2,159,054 A * 5/1939 Silver ..... A43B 7/14 36/145
2,411,901 A * 12/1946 Silver ..... A43B 7/1415 36/145
2,421,088 A * 5/1947 Sims ..... A43B 17/00 36/174
2,569,721 A * 10/1951 Juers ..... A43B 7/1425 36/145
2,909,854 A * 10/1959 Edelstein ..... A43B 7/1425 36/140
2,985,970 A * 5/1961 McCarthy ..... A43B 13/00 12/142 R
3,003,501 A * 10/1961 Lynch ..... A43B 7/14 36/141
3,394,473 A * 7/1968 Romen ..... A43B 13/41 36/154
4,541,184 A * 9/1985 Leighton ..... A43B 7/144 36/178
4,793,078 A * 12/1988 Andrews ..... A43B 7/142 36/43
5,329,705 A * 7/1994 Grim ..... A43B 1/0009 36/110
5,542,196 A * 8/1996 Kantro ..... A43B 1/0045 36/174
5,768,803 A * 6/1998 Levy ..... A43B 7/1425 36/140

(Continued)

*Primary Examiner* — Marie Bays

(57) ABSTRACT

A padded foot support with a ball of foot depression is a shoe insole designed to alleviate pressure from the second and third metatarsals of a foot by redistributing pressure to the first, fourth and fifth metatarsals. A forefoot depression traverses into the top surface of a pad body made of an elastically compressible material in the second and third metatarsal region, slightly forward and inside of center on the forefoot portion of the pad body.

15 Claims, 7 Drawing Sheets

(56) References Cited

U.S. PATENT DOCUMENTS 6,205,685 B1 * 3/2001 Kellerman ..... A43B 1/0072 36/160
6,277,088 B1 * 8/2001 Novella ..... A43B 7/1425 128/898
6,589,630 B1 * 7/2003 Crow ..... A43B 13/04 36/24
6,604,301 B1 * 8/2003 Manoli, II ..... A43B 7/141 36/144
8,166,674 B2 * 5/2012 Dananberg ..... A43B 7/1435 36/144
8,356,427 B2 * 1/2013 Svae ..... A43B 7/1425 36/140
9,055,781 B2 * 6/2015 Tzeng ..... A43B 7/1425
2004/0025377 A1 * 2/2004 Brannon ..... A43B 13/226 36/59 R
2004/0134103 A1 * 7/2004 Kohler ..... A61F 13/067 36/71
2004/0261291 A1 * 12/2004 Paek ..... A43B 7/1425 36/25 R
2005/0228332 A1 * 10/2005 Bushby ..... A43B 7/142 602/61
2006/0026868 A1 * 2/2006 Grisoni ..... A43B 7/1425 36/71
2006/0086005 A1 * 4/2006 Yerian ..... A43B 1/0027 36/71
2009/0090028 A1 * 4/2009 Moramarco ..... A43B 3/102 36/96
2010/0170107 A1 * 7/2010 Tzeng ..... A43B 7/1425 36/28
2011/0023324 A1 * 2/2011 Dananberg ..... A43B 7/1435 36/10
2011/0232129 A1 * 9/2011 Roberts ..... A43B 7/1425 36/88
2012/0255199 A1 * 10/2012 Tzeng ..... A43B 7/1425 36/43
2016/0174653 A1 * 6/2016 Goodman ..... A43B 7/1425 36/43

* cited by examiner

PADDED FOOT SUPPORT WITH A BALL OF FOOT DEPRESSION

The current application claims a priority to the U.S. Provisional Patent application Ser. No. 62/093,115 filed on Dec. 17, 2015.

FIELD OF THE INVENTION

The present invention relates generally to footwear. More particularly, the present invention relates to padded footwear insoles.

BACKGROUND OF THE INVENTION

One of the most frequent pains that one may feel is common through the feet. The part of the foot which takes the most impact in weight-bearing activities like walking, running, standing, wearing high heels, or exercising is the ball of the foot. It is a common problem for people to experience pain in the ball of the foot, or metatarsalgia, when wearing high heels or performing weight bearing activities. The foot has five metatarsal bones numbered one through five in ascending order from the medial side of the foot (the side of the great toe). Each metatarsal bone has a head located in the ball of the foot that connects with the base of a corresponding proximal phalanx bone, forming a metatarsophalangeal joint. Metatarsalgia is localized in the area around the metatarsophalangeal joints, most often under the metatarsal heads. The second and third metatarsal heads usually bear most of the body's weight at the ball of foot. As a result, many sufferers of metatarsalgia may develop a callus at the second and third metatarsal heads. There are currently no padded foot supports for shoes on the market today that treat ball of foot discomfort for the general public with the dual approach of a padded foot support surface with a "hallow zone" created by a depression at the second and third metatarsal heads. Many foot supports provide padding or cushioning to the ball of foot. Some of these devices can redistribute some of the pressure at the ball of foot, but none of these padded foot supports for general public use utilize a hollow zone approach to maximize pressure redistribution capabilities at the ball of the foot. This invention is unique to general public use and not intended to be compared to custom fitting a person's shoe or foot support surface to address the individual's foot problems.

Ladies love to wear high heels, but unfortunately they are a common cause of ball of foot pain as they throw the body weight forward, specifically on the ball of foot where the metatarsal heads come in contact. Relief from this kind of weight-bearing pressure and pain is better treated when the body's weight is more evenly distributed at the ball of foot, allowing all five metatarsal heads to carry their share of the load. When a lady wears high heels for an extended period of time, metatarsalgia can be acute. They try padded foot supports at the ball of foot, but the pain is still present because the amount of force from their body weight is not effectively distributed to all the metatarsal heads. This invention redistributes the pressure of body weight more evenly to all metatarsal heads at the ball of the foot because it combines the benefits of a padded foot support surface with a "hollow zone", which is capable of redistributing the pressure from the metatarsal heads that experience the most pressure to the metatarsal heads that experience the least amount of pressure. The second and third metatarsal heads, which generally take on the most pressure from body weight, will sink into the hollow zone of the padded foot support surface. When this happens, the other more tolerant metatarsal heads take on more body weight pressure. The high heel especially becomes more comfortable with the invention.

The invention is a padded foot support with an oblong and slightly bell curved type depression generally placed where the second and third metatarsal heads are expected to make contact with a shoe.

DETAIL DESCRIPTIONS OF THE INVENTION

All illustrations of the drawings are for the purpose of describing selected versions of the present invention and are not intended to limit the scope of the present invention. The present invention is to be described in detail and is provided in a manner that establishes a thorough understanding of the present invention. There may be aspects of the present invention that may be practiced without the implementation of some features as they are described. It should be understood that some details have not been described in detail in order to not unnecessarily obscure focus of the invention.

The present invention is a padded foot support with an oblong and preferably slightly bell curved type depression generally positioned where the second and third metatarsal heads are expected to make contact with the padded foot support inside of a shoe. The padded foot support can be integrated into a stock, built-in sole of a shoe, or it may be an aftermarket insert/insole that is removably placed over a stock sole and generally covers at least the ball of the foot. The padded foot support will be capable of some degree of pressure redistribution from the second and third metatarsal heads.

Figure 1:
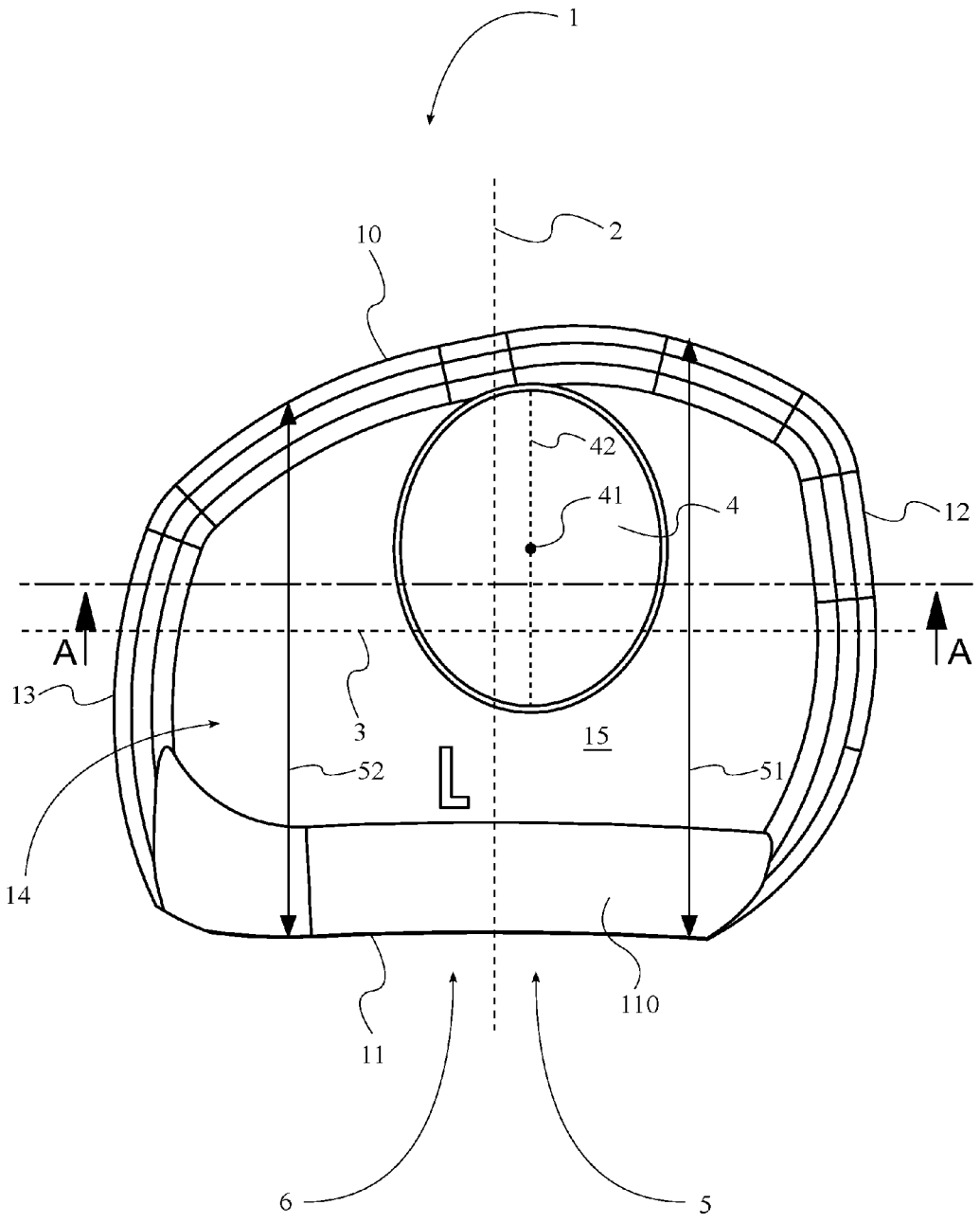
FIG. 1 is a top view of the left foot embodiment of the forefoot embodiment of the present invention.
Figure 2:
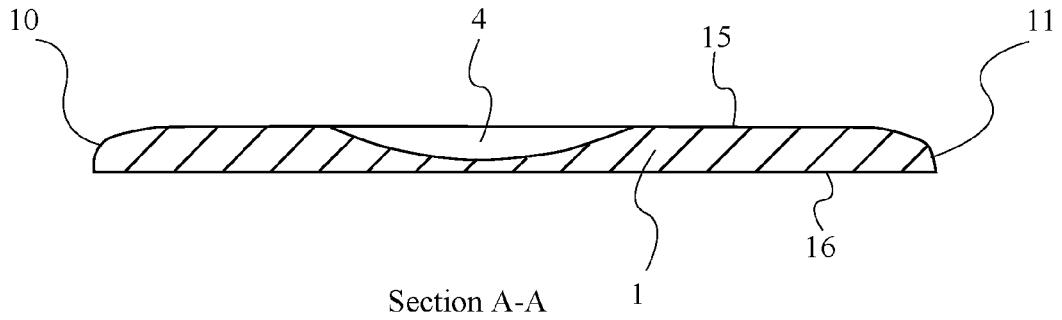
FIG. 2 is the side sectional view A-A of FIG. 1.

Referring to FIGS. 1-2, the present invention comprises a pad body 1, which comprises an anterior edge 10, a posterior edge 11, a first lateral edge 12, a second lateral edge 13, a medial portion 14, a top surface 15, and a bottom surface 16. A forefoot depression 4 traverses into the top surface 15 of the pad body 1.

The pad body 1 is comprised of elastically compressible material, wherein the elastically compressible material has pressure redistribution properties. In the preferred embodiment of the present invention, the elastically compressible material is a pressure redistribution material. The elastically compressible material may be materials such as, but not limited to, a resilient solid material capable of cushioning and redistributing pressure throughout the metatarsophalangeal region, or ball of the foot, such as but not limited to one or more of the following substances: viscoelastic foam, elastic foam, closed cell foam, open cell foam, gel, a pad, an elastomer, and other materials that function to cushion and redistribute pressure. The padded foot support may include disposed within any of the aforementioned materials one or more cells or bladders encapsulating a fluid such as but not limited to air, water, other viscous fluid, or any combination thereof. Furthermore, the padded foot support may be formed by layering two or more of any of the aforementioned pressure redistribution materials.

The anterior edge 10 is the forward end of the pad body 1, which is positioned toward the toe of a shoe. The anterior edge 10 is generally shaped to conform to the forward most end of a shoe. The posterior edge 11 is positioned longitudinally opposite the anterior edge 10 on the pad body 1, toward the heel of the shoe. When configured as a removable insert, the padded foot support is dimensioned such that the posterior end is positioned behind the five metatarsal heads of the foot. In this manner, the padded foot support covers at least the ball of the foot and may extend further rearward to the midfoot or the hindfoot.

Figure 3:
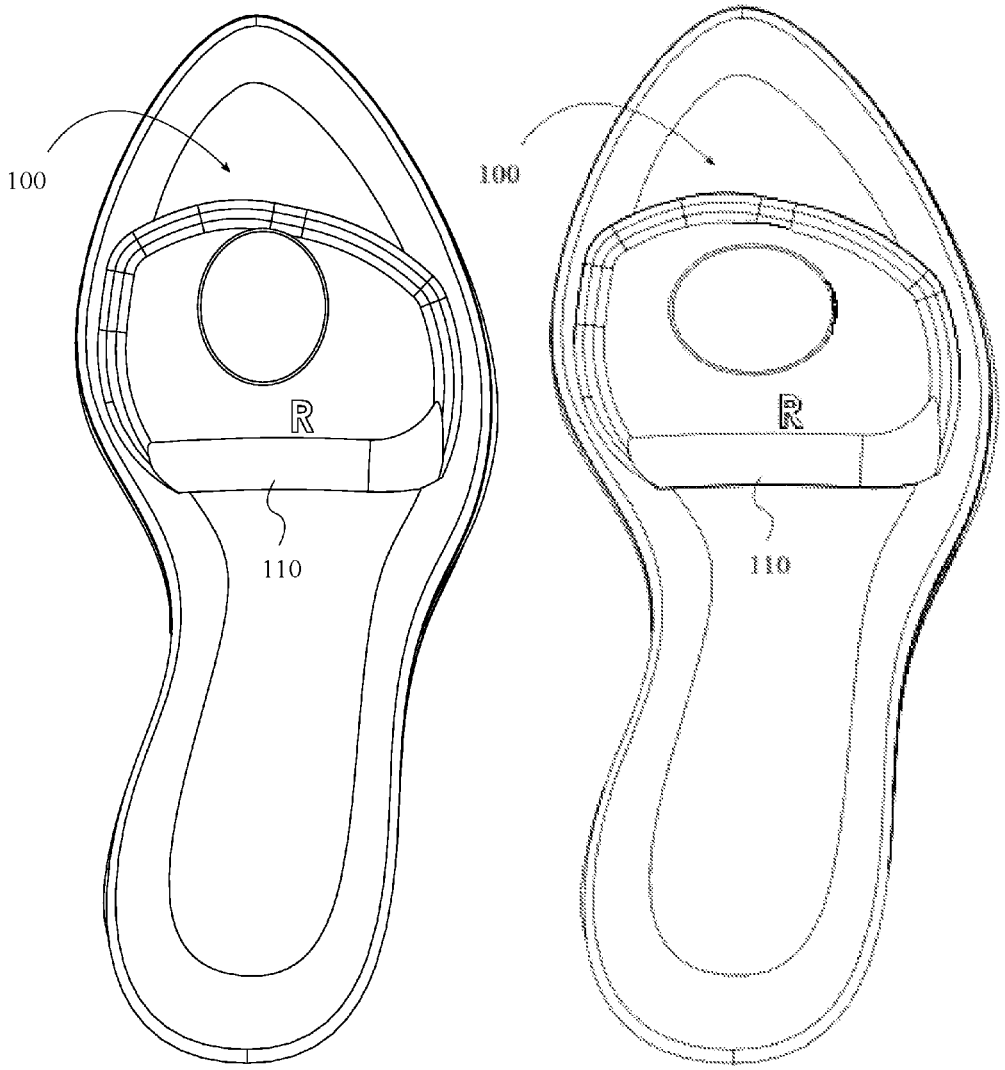
FIG. 3 is an illustration of the present invention being positioned within a shoe.

The first lateral edge 12 and the second lateral edge 13 are the left and right edges of the pad body 1, and are positioned laterally opposite each other on the pad body 1. The anterior edge 10, the posterior edge 11, the first lateral edge 12, and the second lateral edge 13 are not straight or simply curved edges, since the pad body 1 is shaped to fit into footwear. Thus, the pad body 1 is laterally and longitudinally asymmetrical, as is the shape of a typical human foot and the shape of a typical shoe. FIG. 3 shows an internal view of the present invention positioned into a shoe.

The top and bottom surfaces may be integrally formed with the padded foot support, or they may consist of a different material where any of the aforementioned pressure redistribution materials is disposed there between. The top surface 15 supports the foot and the bottom surface 16 contacts the shoe. When configured as a removable insert, the padded foot support may be secured to the insole of a shoe by an adhesive either on the top surface 15 or bottom surface 16 of the padded foot support.

The longitudinal direction herein referred to is a forward-rearward direction along which the toe and heel of a shoe are positioned opposite each other, with the lateral direction being a left-right direction perpendicular to the longitudinal direction.

The medial portion 14 is bounded by the posterior edge 11, the first lateral edge 12, the anterior edge 10 and the second lateral edge 13. The medial portion 14 is simply the main area of the pad body 1 within the aforementioned edges. A lateral forefoot centerline 2 is laterally centered on the pad body 1, and a longitudinal forefoot centerline 3 is longitudinally centered on the pad body 1.

It should be understood that the present invention is intended to describe embodiments for both the left and right feet, being mirror images of each other. As such, for a left foot embodiment, the first lateral edge 12 is the right edge, and the second lateral edge 13 is the left edge. For a right foot embodiment, the first lateral edge 12 is the left edge, and the second lateral edge 13 is the right edge.

At this point it should be made clear that the lateral forefoot centerline 2 and the longitudinal forefoot centerline 3 are centered on a forefoot portion 100 of the pad body 1. In a basic embodiment where the pad body 1 solely comprises the forefoot portion 100, the lateral forefoot centerline 2 and the longitudinal forefoot centerline 3 are laterally and longitudinally centered, respectively, on the pad body 1. However, in embodiments where the pad body 1 further comprises an arch portion 101 for a half insole shape or an arch portion 101 and a heel portion 102 for a full insole shape, the lateral forefoot centerline 2 and longitudinal forefoot centerline 3 are no longer centered on the pad body 1 as a whole, but remain centered on the forefoot portion 100.

The pad body 1 comprises a first lateral half 5 and a second lateral half 6, wherein the first lateral half 5 and the second lateral half 6 are separated by the lateral forefoot centerline 2. The first lateral half 5 is between the lateral forefoot centerline 2 and the first lateral edge 12, and the second lateral half 6 is between the lateral forefoot centerline 2 and the second lateral edge 13. Due to the shape of the human foot, the present invention is laterally asymmetrical. The portion of the present invention for the inside half of the forefoot, or the big toe half, is longer longitudinally to account for the length of toes decreasing from the first or big toe to the fifth or pinky toe. Thus, a first distance 51 between the posterior edge 11 of the first lateral half 5 and the anterior edge 10 of the first lateral half 5 is greater than a second distance 52 between the posterior edge 11 of the second lateral half 6 and the anterior edge 10 of the second lateral half 6. More simply stated, the first lateral half 5 is longer longitudinally than the second lateral half 6.

The primary focus of the present invention is the placement of the forefoot depression 4. The forefoot depression 4 is formed in the top surface 15 of the pad body 1 near the anterior edge 10, generally where the second and third metatarsal heads are expected to make contact with the insole of a shoe.

In the preferred embodiment of the present invention, the forefoot depression 4 has a generally oblong or oval shape. More particularly, the forefoot depression 4 has an oval profile or an elliptical profile, with the forefoot depression 4 being a partial ellipsoid traversing into the top surface 15 of the pad body 1. In the preferred embodiment of the present invention, a semi-major axis 42 of the elliptical profile is oriented longitudinally. In an alternate embodiment, the semi-major axis 42 of the elliptical profile is oriented laterally.

A center point 41 of the forefoot depression 4 is positioned between the lateral forefoot centerline 2 and the first lateral edge 12, and between the longitudinal forefoot centerline 3 and the anterior edge 10. To adequately place the forefoot depression 4 where the second and third metatarsals of a foot are expected to contact, the forefoot depression 4 is generally close to the center of the forefoot portion 100 of the pad body 1, but positioned slightly to the first lateral edge 12 or big toe side and toward the anterior edge 10. To be more specific, in one preferred embodiment of the present invention, the center point 41 of the forefoot depression 4 is positioned six elevenths of the way from the second lateral edge 13 to the first lateral edge 12, and seven elevenths of the way from the posterior edge 11 to the anterior edge 10.

When a user places his or her foot on the padded foot support, the second and third metatarsal heads sink into the hollow zone of the forefoot depression 4 while the other metatarsal heads rest upon the surrounding elevated portions of the top surface 15. As a result, pressure due to body weight is redistributed to the first, fourth, and fifth metatarsal heads, removing pressure from the second and third metatarsal heads and creating a more even pressure distribution along the ball of the user's foot. The even distribution of pressure and cushioning provided by the material of the padded foot support allow for adequate support over the entire ball of the foot, providing pain relief and shock absorption during weight-bearing activities like walking, running, standing, wearing high heels, or exercising.

As previously discussed, the basic embodiment of the present invention is simply a forefoot pad, with the pad body 1 being a forefoot portion 100 of an insole, and the posterior edge 11 being positioned approximately where the arch of a person's foot would be expected to begin. One optional feature for the forefoot pad embodiment is a sloped portion 110 that is positioned on the pad body 1 adjacent to the anterior edge 10. The sloped portion 110 traverses from the top surface 15 toward the bottom surface 16 and toward the anterior edge 10. The sloped portion 110 provides a gradual transition from the top surface 15 of the pad body 1 to the sole of the shoe for comfort to the user.

Figure 4:
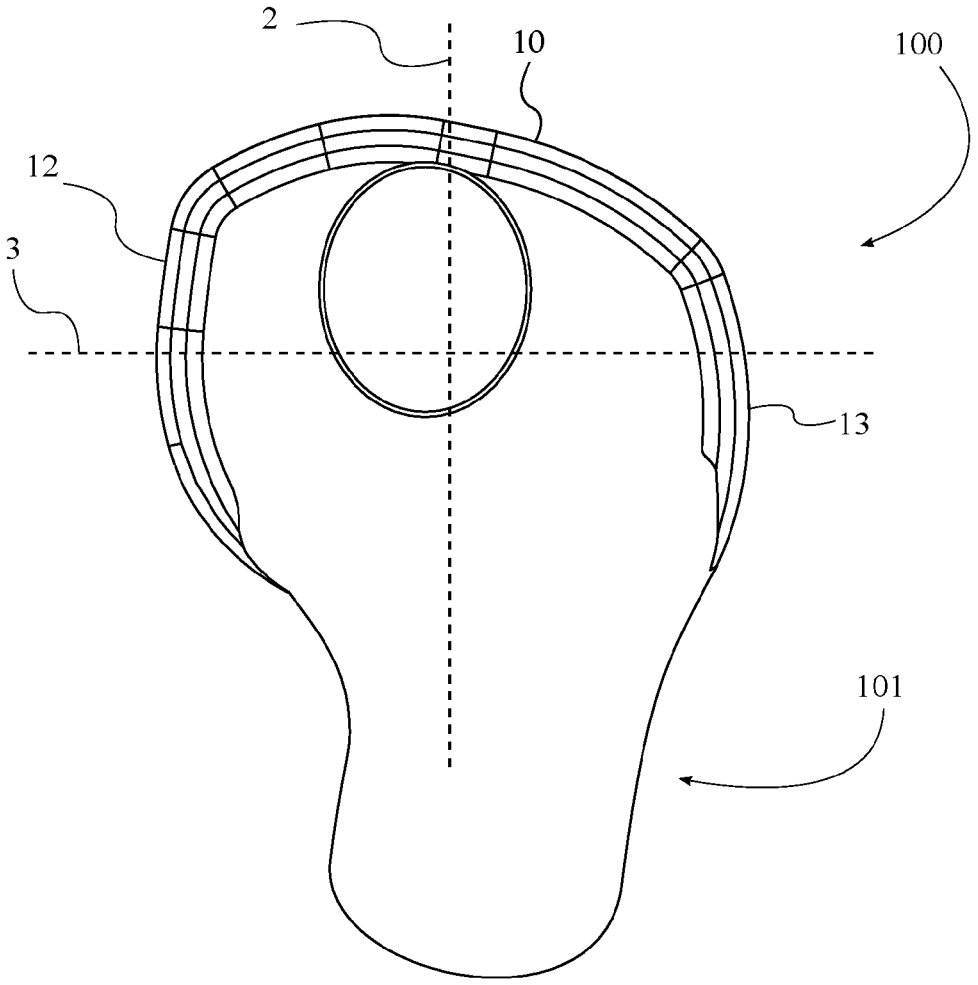
FIG. 4 is a top view of the present invention as a half insole embodiment.

In a half insole embodiment shown in FIG. 4, the pad body 1 comprises a forefoot portion 100 and an arch portion 101, so that the pad body 1 comprises a half insole shape. In this embodiment, the arch portion 101 is connected to the forefoot portion 100 opposite the anterior edge 10. The lateral forefoot centerline 2 is still laterally centered on the forefoot portion 100, not the pad body 1 as a whole, and similarly the longitudinal forefoot centerline 3 is still longitudinally centered on the forefoot portion 100.

Figure 5:
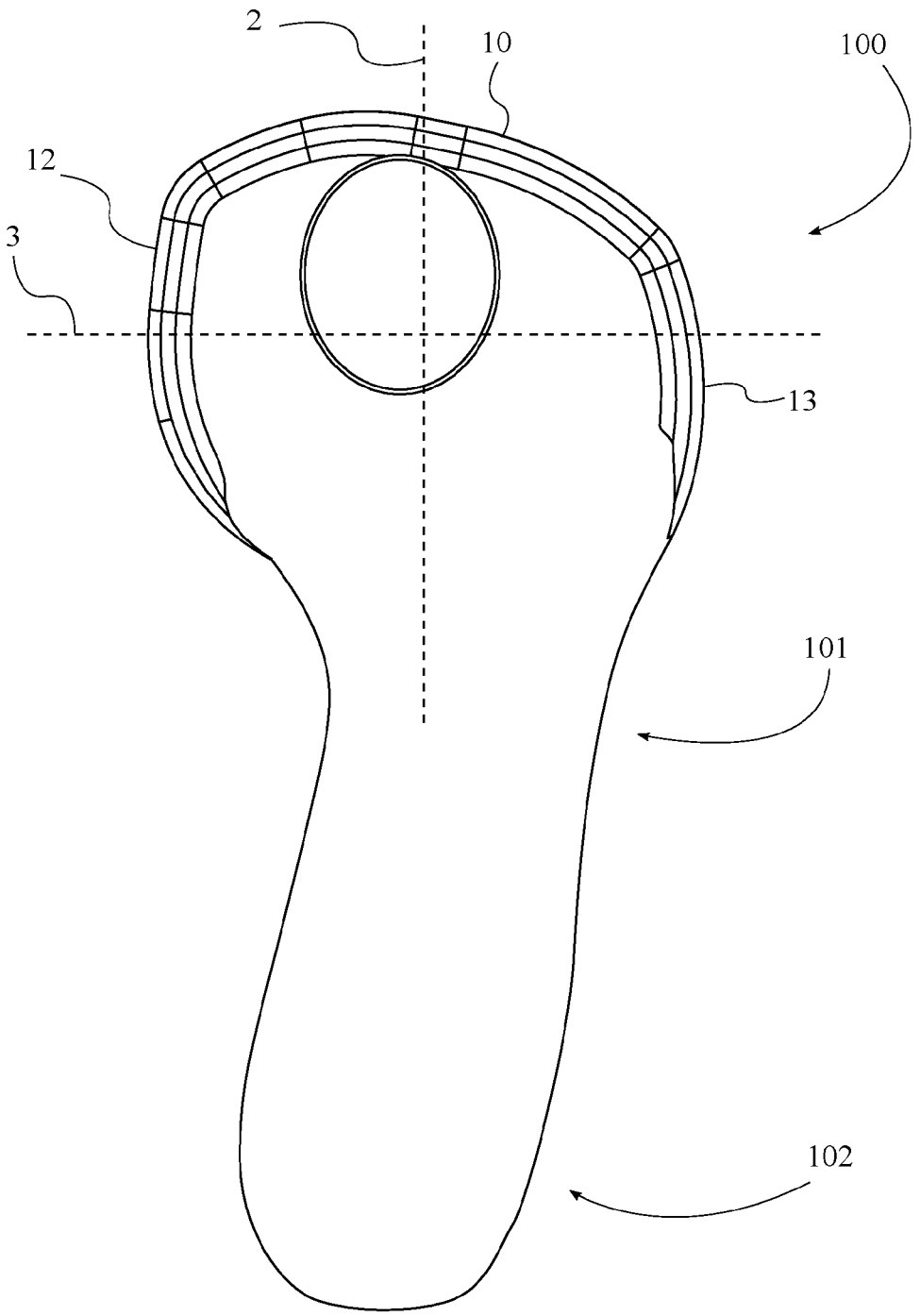
FIG. 5 is a top view of the present invention as a full insole embodiment.

In a full insole embodiment shown in FIG. 5, the pad body 1 comprises the forefoot portion 100, the arch portion 101, and a heel portion 102, with the pad body 1 being a full insole shape. As before the arch portion 101 is connected to the forefoot portion 100 opposite the anterior edge 10. The heel portion 102 is connected to the arch portion 101 opposite the forefoot portion 100. As in the half insole embodiment, the lateral forefoot centerline 2 is still laterally centered on the forefoot portion 100, not the pad body 1 as a whole, and similarly the longitudinal forefoot centerline 3 is still longitudinally centered on the forefoot portion 100.

Figure 6:
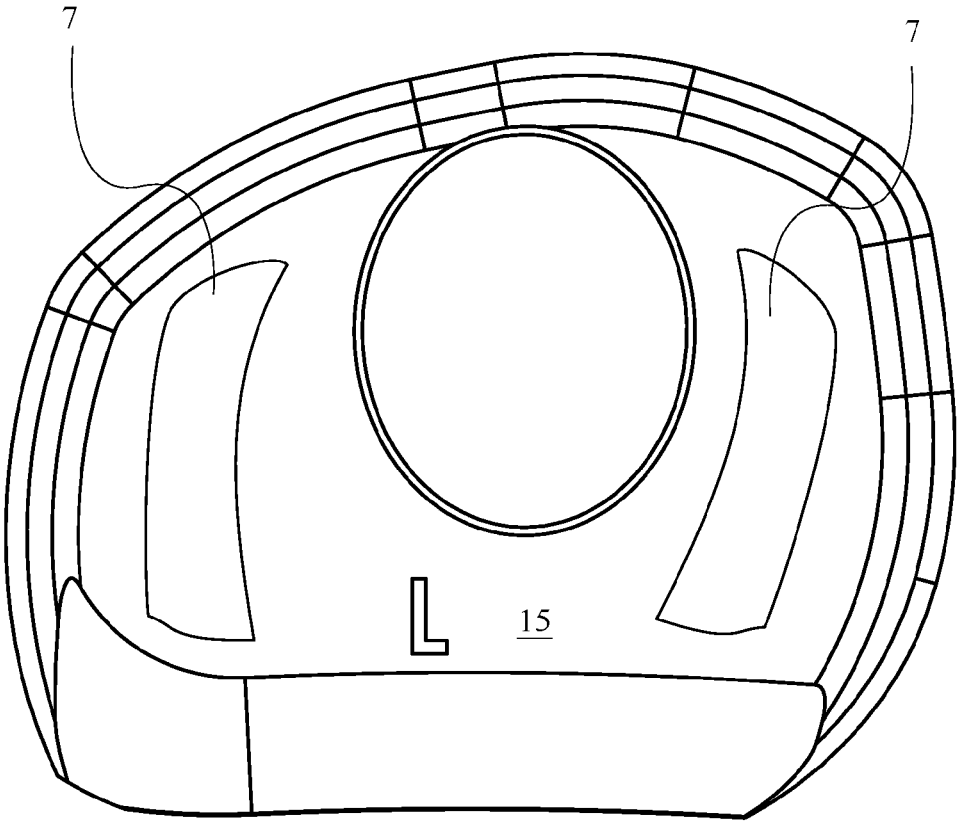
FIG. 6 is a top view of the present invention showing the foot adhesive zone.
Figure 7:
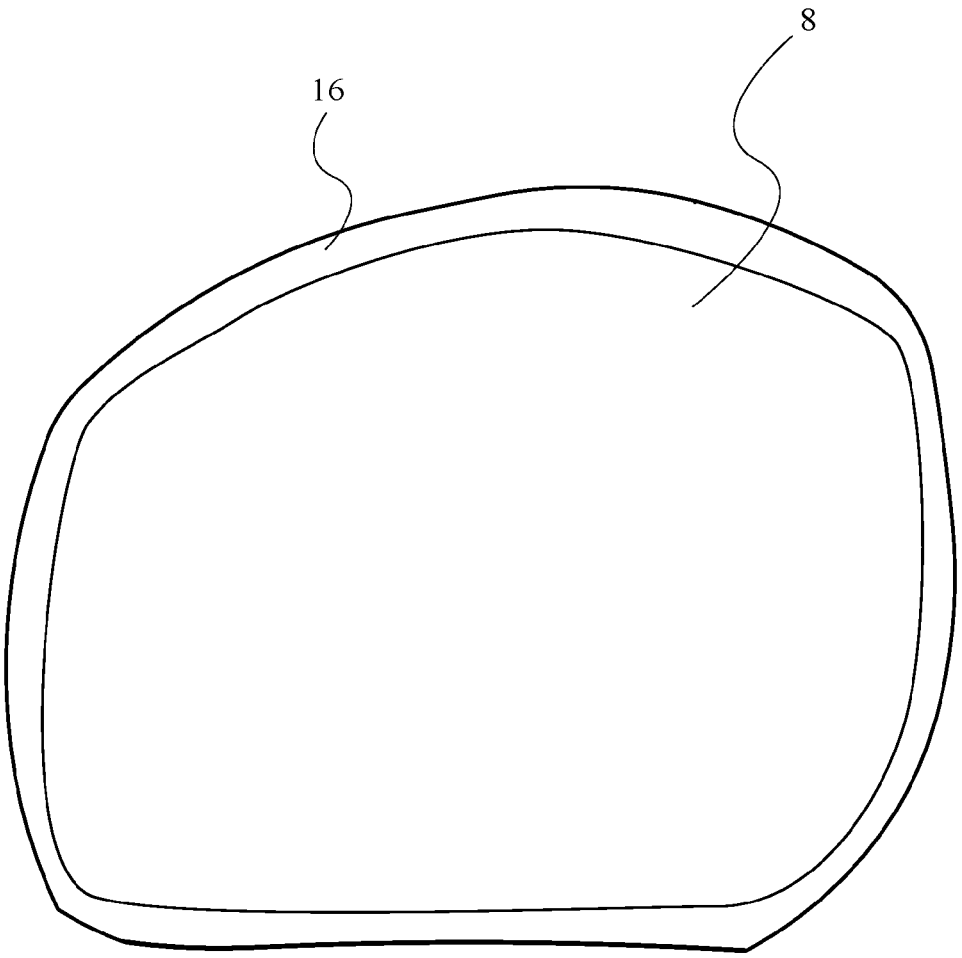
FIG. 7 is a bottom view of the present invention showing the shoe adhesive zone.

An additional feature the present invention may comprise is a foot adhesive zone 7, as shown in FIG. 6. The foot adhesive zone 7 is connected to the top surface 15 of the pad body 1 so that the present invention stays properly in position without shifting while in use. A footwear adhesive zone 8, shown in FIG. 7, may additionally or alternatively be comprised and connected to the bottom surface 16 of the pad body 1 for similar functionality as the foot adhesive zone 7 but between the present invention and the sole of a shoe.

Although the invention has been explained in relation to its preferred embodiment, it is to be understood that many other possible modifications and variations can be made without departing from the spirit and scope of the invention as hereinafter claimed.

What is claimed is:

1. A padded foot support comprising:
a singular pad body;
the singular pad body comprising an elastically compressible material and a forefoot portion;
the elastically compressible material comprising pressure redistribution properties;
the elastically compressible material being a pressure redistribution material;
the forefoot portion comprising
an anterior edge,
a posterior edge,
a first lateral edge,
a second lateral edge,
a medial portion,
a top surface,
a bottom surface and
a singular forefoot depression;
the anterior edge and the posterior edge being positioned longitudinally opposite each other on the forefoot portion;
the first lateral edge and the second lateral edge being positioned laterally opposite each other on the forefoot portion;
the medial portion being bounded by the posterior edge, the first lateral edge, the anterior edge and the second lateral edge;
the singular forefoot depression traversing into the top surface without penetrating the bottom surface;
the singular forefoot depression being positioned on the top surface;
the singular forefoot depression being located at the medial portion;
the medial portion comprising a region surrounding the singular forefoot depression;
the region being substantially of a consistent elevation;
the forefoot portion comprising a lateral forefoot centerline and a longitudinal forefoot centerline;
the lateral forefoot centerline being laterally centered on the forefoot portion;
the longitudinal forefoot centerline being longitudinally centered on the forefoot portion;
the forefoot portion being divided into four quadrants by the lateral forefoot centerline and the longitudinal forefoot centerline; and
an area of the region surrounding the singular forefoot depression being greater than an area of the singular forefoot depression in each of the four quadrants.

2. The padded foot support as claimed in claim 1 comprising:
the singular pad body being laterally and longitudinally asymmetrical.

3. The padded foot support as claimed in claim 1 comprising:
the forefoot portion comprising a first lateral half and a second lateral half;
the first lateral half and the second lateral half being separated by the lateral forefoot centerline; and
a first distance between the posterior edge at the first lateral half and the anterior edge at the first lateral half being greater than a second distance between the posterior edge at the second lateral half and the anterior edge at the second lateral half.

4. The padded foot support as claimed in claim 1 comprising:
the singular forefoot depression comprising an oval profile.

5. The padded foot support as claimed in claim 1 comprising:
the singular forefoot depression comprising an elliptical profile; and
the singular forefoot depression being a partial ellipsoid traversing into the top surface.

6. The padded foot support as claimed in claim 5 comprising:
a semi-major axis of the elliptical profile being oriented longitudinally.

7. The padded foot support as claimed in claim 5 comprising:
a semi-major axis of the elliptical profile being oriented laterally.

8. The padded foot support as claimed in claim 1 comprising:
the singular pad body comprising a sloped portion;
the sloped portion being formed on the singular pad body adjacent to the posterior edge; and
the sloped portion traversing from the top surface toward the bottom surface and toward the posterior edge.

9. The padded foot support as claimed in claim 1 comprising:

the singular pad body comprising an arch portion and a heel portion;

the arch portion being connected to the forefoot portion opposite the anterior edge;

the heel portion being connected to the arch portion opposite the forefoot portion; and the forefoot portion, the arch portion and the heel portion jointly forming a full insole shape.

10. The padded foot support as claimed in claim 1 comprising:

the singular pad body comprising an arch portion;

the arch portion being connected to the forefoot portion opposite the anterior edge; and the forefoot portion and the arch portion jointly forming a half insole shape.

11. The padded foot support as claimed in claim 1 comprising:

a foot adhesive zone; and the foot adhesive zone being connected to the top surface.

12. The padded foot support as claimed in claim 1 comprising:

a footwear adhesive zone; and the footwear adhesive zone being connected to the bottom surface.

13. The padded foot support as claimed in claim 1 comprising:

the singular forefoot depression comprising a center point;

the center point being positioned in between the lateral forefoot centerline and the first lateral edge; and the center point being positioned in between the longitudinal forefoot centerline and the anterior edge.

14. The padded foot support as claimed in claim 1 comprising:

the singular forefoot depression comprising a slope; and the slope being formed by gradually dropping from the top surface toward the bottom surface.

15. The padded foot support as claimed in claim 1 comprising:

the singular pad body comprising a chamfered portion;

the chamfered portion being formed on the forefoot portion adjacent to the anterior edge, the first lateral edge and the second lateral edge;

the chamfered portion traversing into the top surface;

a part of the chamfered portion adjacent to the anterior edge and a part of a periphery of the singular forefoot depression adjacent to the anterior edge superimposing with each other; and the region substantially of the consistent elevation being extended from the periphery of the singular forefoot depression to the chamfered portion.

* * * * *